US006669118B2

(12) United States Patent
Webster

(10) Patent No.: US 6,669,118 B2
(45) Date of Patent: Dec. 30, 2003

(54) COHERENT JET NOZZLES FOR GRINDING APPLICATIONS

(75) Inventor: John A. Webster, Storrs, CT (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 10/206,029

(22) Filed: Jul. 26, 2002

(65) Prior Publication Data

US 2003/0094515 A1 May 22, 2003

Related U.S. Application Data

(60) Provisional application No. 60/313,733, filed on Aug. 20, 2001.

(51) Int. Cl.[7] ..... A62C 2/08; B05B 1/14; B05B 1/00

(52) U.S. Cl. ..... 239/548; 239/550; 239/553.3; 239/554; 239/561; 239/596

(58) Field of Search ..... 239/548, 550, 239/553.3, 553.5, 554, 555, 561, 566, 600, 596, 601, 533.1, 533.14, 461, 463, 489, 490, 390, 128

(56) References Cited

U.S. PATENT DOCUMENTS

| | | | | |
|---|---|---|---|---|
| 3,696,780 A | | 10/1972 | Fritzsche | |
| 4,066,117 A | * | 1/1978 | Clark et al. | 164/46 |
| 4,284,245 A | * | 8/1981 | Fishgal | 241/40 |
| 4,377,109 A | * | 3/1983 | Brown et al. | 99/401 |
| 4,615,123 A | * | 10/1986 | Brown | 34/577 |
| 4,754,558 A | * | 7/1988 | Milone | 34/216 |
| 4,951,879 A | * | 8/1990 | Fay et al. | 239/553.5 |
| 5,313,743 A | | 5/1994 | Peschik | |
| 5,651,191 A | * | 7/1997 | Walunas et al. | 34/236 |
| 6,020,572 A | | 2/2000 | Marner et al. | |

OTHER PUBLICATIONS

Cui, Chuanliang and Webster, John, "Experimental Investigation of Coolant Jet Design for Creep Feed Grinding of Gas Turbine Airfoils", ASME Cogen Turbo Power, Oregon, USA, 1994.

Mindek, Richard and Webster, John, "Minimizing Thermal Damage of Aerospace Components Using Coolant Nozzle and Coolant System Optimization", ASME Cogen Turbo Power, Oregon, USA, 1994.

Webster, John and Mindek, Richard, "Grinding Fluid Application System Design", Annals of CIRP, vol. 44/1, Netherlands, 1995.

Webster, John, "Selection of Coolant Type and Application Technique in Grinding", Supergrind, IDA, Connecticut, 1995.

Webster, John, "Improving Superabrasive Grinding Performance by Optimizing Fluid Delivery and Fluid Type", Precision Grinding Conf., Gorham Advanced Materials, Chicago, 1999.

Webster, John, "Designing Coolant Application for Damage Free Grinding", Coolants/Lubricants for Metal Cutting and Grinding, Workshop at Gorham Conference, Chicago, 2000.

* cited by examiner

*Primary Examiner*—Davis D Hwu
(74) *Attorney, Agent, or Firm*—Mary E. Porter, Esq.; Richard L. Sambon, Esq.

(57) ABSTRACT

A nozzle assembly and method is configured to apply coherent jets of coolant in a tangential direction to the grinding wheel in a grinding process, at a desired temperature, pressure and flowrate, to minimize thermal damage in the part being ground. Embodiments of the present invention may be useful when grinding thermally sensitive materials such as gas turbine creep resistant alloys and hardened steels. Flowrate and pressure guidelines are provided to facilitate optimization of the embodiments.

21 Claims, 7 Drawing Sheets

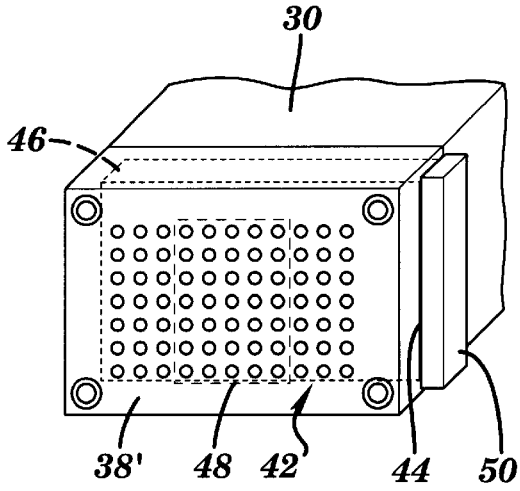
FIG. 7A
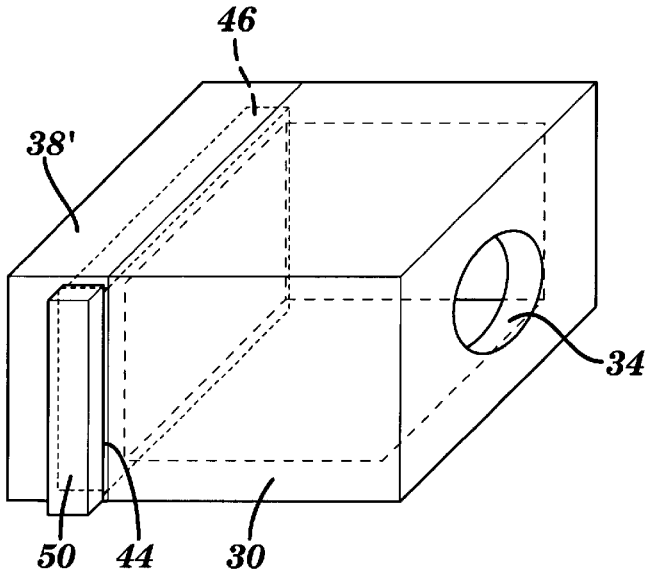
FIG. 7B
FIG. 7C
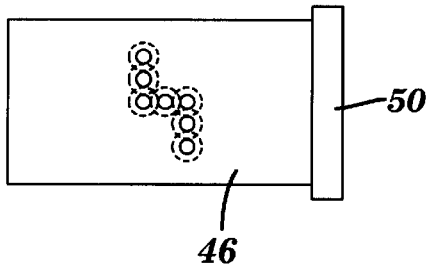

COHERENT JET NOZZLES FOR GRINDING APPLICATIONS

This application claims the benefit of U.S. Provisional Application Ser. No. 60/313,733 filed Aug. 20, 2001.

BACKGROUND

1. Technical Field

This invention relates to supplying coolant to a location of contact between a workpiece and a material removing tool, and more particularly, relates to supplying coolant to grinding operations.

2. Background Information

It is known to equip a grinding machine with a nozzle which can discharge one or more jets, sprays or streams of a suitable liquid coolant to the location of contact between a workpiece and a material removing tool, such as a rotary grinding wheel. The nozzle can be trained or aimed upon the location of contact and is connectable to a source of coolant, e.g., by a hose. Such cooling of the location of contact between a workpiece and a grinding tool beneficially affects the quality of the finished product. This is especially in a modern grinding machine wherein the tool is expected to remove large quantities of material from a workpiece, where inadequate cooling may damage the surface integrity of the workpiece material.

It is further known to design a nozzle in such a way that it can supply adequate quantities of coolant in suitable distribution to the location of contact between a relatively large surface of a workpiece and a suitably profiled working surface of a rotary grinding wheel or an analogous tool. The nozzle may satisfy the requirements regarding the delivery of adequate quantities of coolant in optimum distribution as long as the particular grinding tool remains installed in the machine and as long as such tool is in the process of removing material from a particular series of workpieces. If the particular grinding tool is replaced with another tool of differing profile, or if another profile of the same tool is moved into material removing contact with a workpiece, the nozzle may no longer ensure optimal withdrawal of heat from workpieces. Thus, it is generally necessary to replace the nozzle with a different nozzle in a time-consuming operation which may entail long periods of idleness of the machine. This situation is aggravated if several different profiles of a particular workpiece are to be treated by a set of different tools or by two or more sets of different tools. This necessitates the removal of a previously used grinding tool from the machine.

An additional factor that affects the quality of workpiece cooling is the dispersion of the coolant jet applied to the workpiece. Dispersion has been shown to be disadvantageous because it tends to increase entrained air, and air tends to exclude some coolant from the grinding zone (i.e., grinding wheel/workpiece interface). Dispersion also tends to reduce the accuracy of the aim of the coolant jet, allowing fluid to miss and/or bounce away from the grinding zone. Dispersion may be reduced by the use of relatively long straight sections of hose/tubing immediately upstream of the nozzle. This, however, is impractical in many applications due to the space limitations of many grinding machine installations. In an attempt to overcome this limitation, plenum chambers have been disposed immediately upstream of the nozzle. The relatively large cross-sectional area of the plenum was intended to slow down the coolant velocity and allow it to stabilize before accelerating from the nozzle exit aperture, to improve coherence in applications in which long, straight upstream pipe portions are impractical. However, the relatively large size of such plenum chambers makes them difficult to locate close enough to the grinding zone to provide optimal cooling in many applications.

It has also generally been found that the quality of workpiece cooling may be improved by matching the velocity of the coolant jet to that of the grinding surface of the grinding wheel. To achieve velocity matching, and to minimize dispersion and entrained air, it has generally been found that the jet should reach the grinding zone within about 12 inches (30.5 cm) from the nozzle.

A need exists for an improved coolant nozzle capable of providing coherent jets, and which is easily adjustable to provide optimal coolant flow in a variety of grinding applications and distances from the grinding zone.

SUMMARY

According to one aspect of the invention, a nozzle assembly is provided, which includes a plenum chamber, and a modular front plate removably fastened to a downstream side of the plenum chamber. The assembly also includes at least one coherent jet nozzle disposed for transmitting fluid through the modular front plate, and a conditioner disposed within the plenum chamber.

In another aspect of the invention, a nozzle assembly includes a plenum chamber having a non-circular cross-section in a direction transverse to a downstream fluid flow direction therethrough, at least one coherent jet nozzle disposed at a downstream end of the plenum chamber, and a conditioner sized and shaped to substantially match the cross-section, which is disposed within the plenum chamber.

In yet another aspect, a nozzle assembly includes a plenum chamber configured to pass coolant in a downstream fluid flow direction therethrough, and a plurality of coherent jet nozzles disposed at a downstream end of the plenum chamber.

In a still further aspect, a nozzle assembly includes a plenum chamber, a modular card removably fastenable to a downstream side of the plenum chamber, at least one coherent jet nozzle disposed within the card for transmitting fluid from the plenum chamber therethrough, and a conditioner disposed within the plenum chamber.

Another aspect of the invention involves a method for delivering a coherent jet of grinding coolant to a grinding wheel. The method includes determining a desired flowrate of coolant for a grinding operation, and obtaining a grinding wheel speed at an interface of a grinding wheel with a workpiece. The method further includes determining coolant pressure required to generate a coolant jet speed that matches the grinding wheel speed, determining a nozzle discharge area capable of achieving the flowrate at the pressure, and determining a nozzle configuration.

In another aspect of the present invention, a grinding tool kit includes a dressing roller sized and shaped to impart a profile to a grinding wheel, and a dressing module sized and shaped for being coupled to a plenum chamber. The dressing module includes a plurality of coherent jet dressing nozzles which are sized and shaped for supplying coolant from the plenum chamber to a dressing zone of the grinding wheel. The kit also includes a grinding module sized and shaped for being coupled to another plenum chamber. The grinding module includes a plurality of coherent jet grinding nozzles which are sized and shaped for supplying coolant from the other plenum to a grinding zone of the grinding wheel.

BRIEF DESCRIPTION OF THE DRAWINGS

The above and other features and advantages of this invention will be more readily apparent from a reading of the following detailed description of various aspects of the invention taken in conjunction with the accompanying drawings, in which:

FIGS. 7A and 7B are perspective views, from different sides, of an alternate embodiment of the present invention;

FIG. 7C is a side elevational view of a component of the embodiment of FIGS. 7A and 7B.

DETAILED DESCRIPTION

Figure 1:
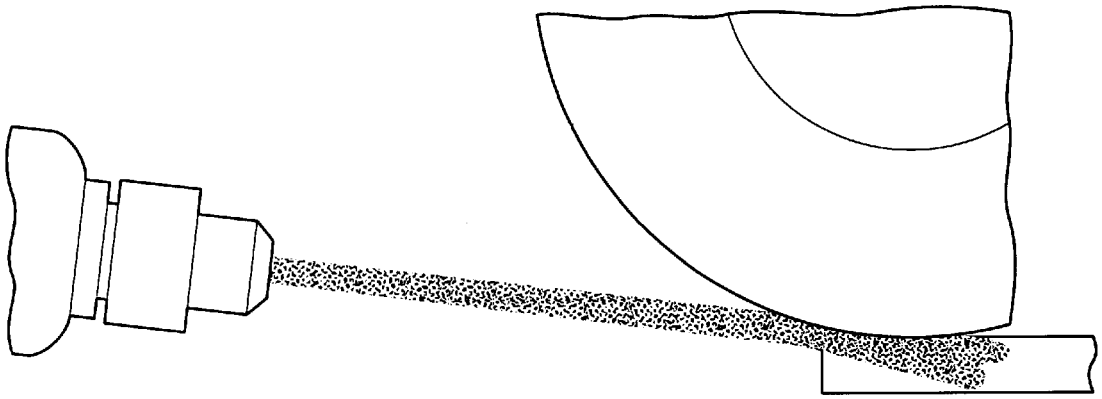
FIG. 1 PRIOR ART
FIG. 1 is an elevational side view of a prior art coolant nozzle applying a coolant spray tangentially to a rotating grinding wheel.

Referring to the figures set forth in the accompanying drawings, the illustrative embodiments of the present invention will be described in detail hereinbelow. For clarity of exposition, like features shown in the accompanying drawings shall be indicated with like reference numerals and similar features as shown in alternate embodiments in the drawings shall be indicated with similar reference numerals.

Embodiments of the present invention are provided with a range of modular nozzle configurations to apply coherent jets of coolant in a nominally tangential direction (e.g., FIG. 1) to a grinding wheel in a grinding process, at a predetermined temperature, pressure, velocity and flowrate, to minimize thermal damage in the part being ground, and tend to improve process economics, such as by higher productivity, longer wheel life and reduced dressing requirements. The aperture of the nozzle exit is determined to provide optimum flow and velocity to cool the grinding process. These embodiments may advantageously be used in precision surface and outer diameter (O.D.) grinding processes, such as creep-feed grinding, flute grinding, centerless grinding, and surface grinding processes employed in various aerospace, automotive and tool manufacturing applications. Many of these processes use a profiled grinding wheel to impart a profiled shape to the surface of the workpiece. The embodiments of this invention may thus be advantageous when grinding thermally sensitive materials such as creep resistant alloys commonly used in gas turbine manufacture, and hardened steels. Embodiments of the present invention provide such coherent jets by use of particular internal nozzle geometries, flow conditioners, and by providing an array of modularized nozzles to nominally match the profile being imparted upon the workpiece. Additional aspects of these embodiments include particular flowrate and pressure ranges associated with the nozzle geometries. Various predetermined nozzle geometries are disposed within a modular key card which may be removably engaged with a coolant system for convenient interchangeability.

Where used in this disclosure, the term "coherent jet" refers to a spray that increases in thickness (e.g., diameter) by no more than 4 times over a distance of about 12 inches (30.5 cm) from the nozzle exit. The term "axial" when used in connection with an element described herein, unless otherwise defined, shall refer to a direction relative to the element, which is substantially parallel to the downstream flow direction therethrough, such as axis 23 of nozzle 22 shown in FIG. 2. The term "transverse" refers to a direction substantially orthogonal to the axial direction. The term "transverse cross-section" refers to a cross-section taken along a plane oriented substantially orthogonally to the axial direction.

The present invention may be used with nominally any grinding machine, provided that the pressure applied to deliver coolant through the nozzles can be adapted to achieve the desired levels taught herein. Advantageously, various embodiments of the present invention may provide savings in set-up time needed to adjust the grinding machine, grinding wheel, workpiece, dressing wheel and coolant to run a grinding operation, and reduction in workpiece burn, improvement in part quality, and an increase in grinding wheel life by improved dressing wheel efficiency.

Potential advantages of various embodiments of the present invention include enabling the nozzle assembly to be located further away (i.e., greater than 12 inches or 30.5 cm) from the grinding zone, to reduce mechanical interference with the workpiece and fixture. Some embodiments permit the grinding wheel to be dressed less frequently, or by smaller amounts, than those using conventional coolant assemblies, to increase grinding wheel life and/or generate less downtime due to less frequent wheel changing. Improved application of coolant tends to generate less thermal damage to workpieces, and/or may generate higher yield than attainable using conventional coolant assemblies. Embodiments of the invention also tend to reduce entrained air in the coolant spray to reduce creation of foam when using water-based coolants. The relatively low dispersion of the coolant spray generated by these embodiments tends to improve the aim of the coolant into the grinding zone for improved utilization of the applied flow. This improved dispersion also generally reduces misting of the coolant spray. Moreover, these embodiments include modular nozzles which may be quickly changed, to reduce grinding machine downtime during changeover.

Figure 2:
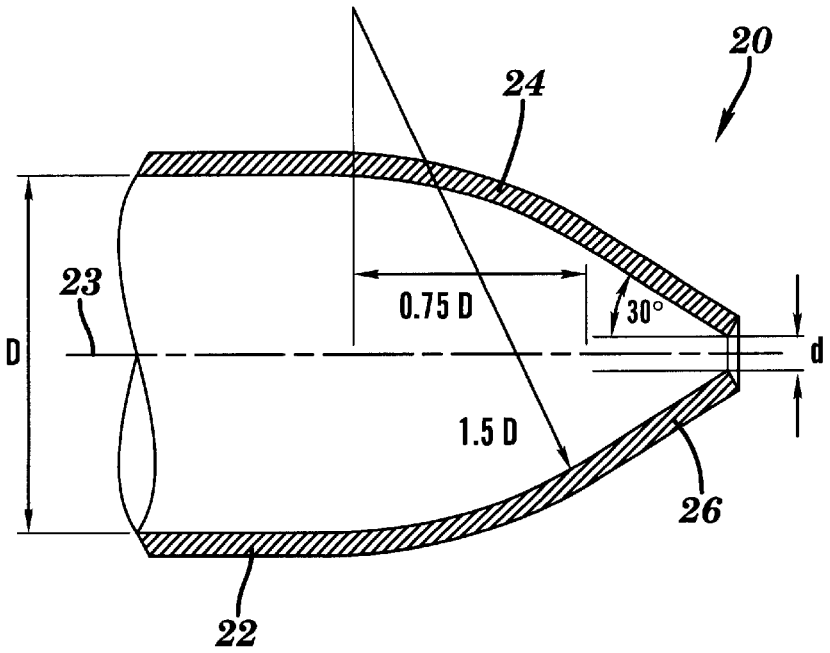
FIG. 2 is a schematic cross-sectional view of a nozzle useful in various embodiments of the present invention.

Referring now to FIGS. 2–8, the present invention will be more thoroughly described. Turning to FIG. 2, an exemplary coherent jet nozzle 20 useful in the present invention is shown. Nozzle 20 is provided with a geometry that includes a cylindrical base 22 having an axis 23 and a diameter D. Base 22 fairs (i.e., blends) into a radiused midsection 24 having a radius of 1.5D and an axial length of ¾D. The midsection further blends into a conical distal end 26 disposed at a 30 degree angle to axis 23, and which has an outlet of diameter d. The nozzle 20 is provided with a ratio of D:d (i.e., a 'contraction ratio') of at least about 2:1. These nozzles 20 may be provided with exit diameters from 0.040 inches (1 mm) to 1 inch (2.5 cm) diameter for most grinding applications. For a given fluid pressure, as the diameter increases the flowrate will increase by the square of the diameter change, leading to relatively high overall flowrate, which may make a rectangular nozzle 20' (described below) more desirable in some applications. A plurality of nozzles 20 may be clustered together to cool a relatively large grinding width, as will be discussed hereinbelow.

Figure 3:
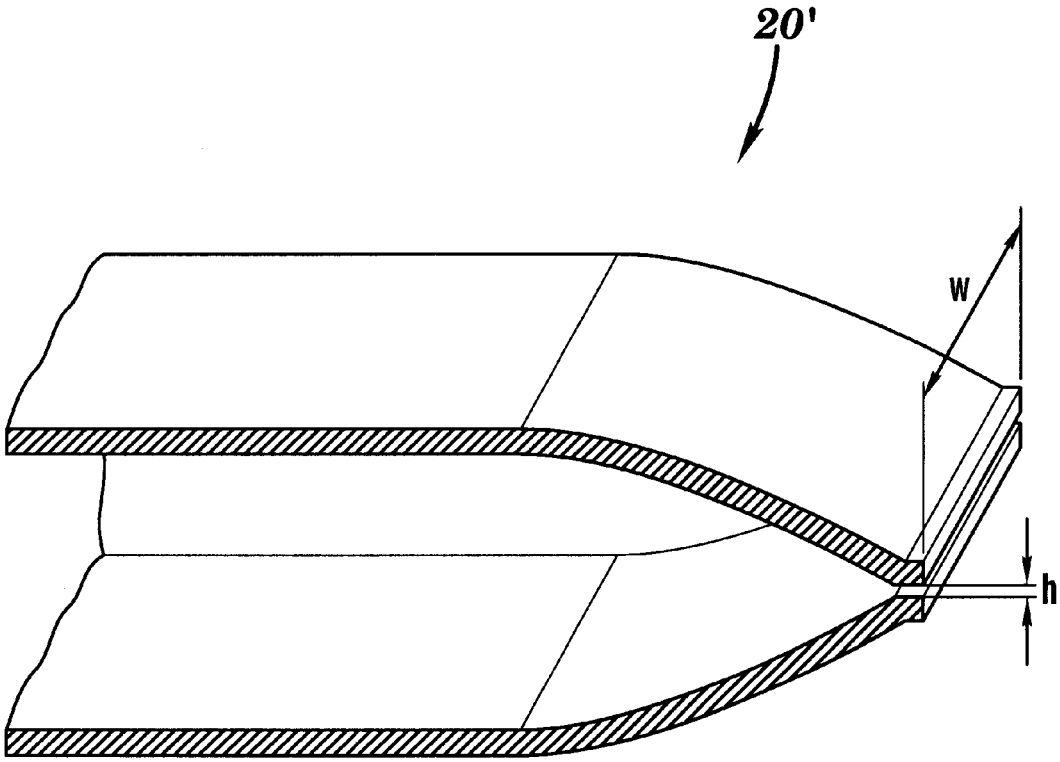
FIG. 3 is a schematic, cross-sectional, perspective view of an alternate nozzle useful in various embodiments of the present invention.

Another coherent jet nozzle suitable for use with the present invention is rectangular nozzle 20' shown in FIG. 3. Nozzle 20' has a longitudinal cross-section which is nominally identical to that of round nozzle 20. However, nozzle 20' includes a rectangular, rather than circular, transverse cross-sectional geometry. Thus, nozzle 20' has an exit defined by a height h (which corresponds to diameter d of nozzle 20), and a width w. Nozzles 20' may be used effectively in applications in which the grinding zone or cut has a width (i.e., dimension of the grinding zone parallel to the axis of rotation of the grinding wheel) of 0.5 inches (1.3 cm) and greater.

Figure 4A:
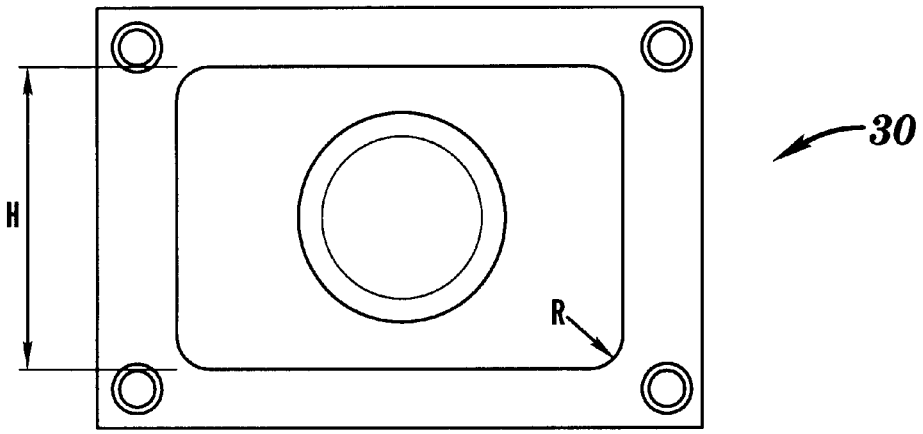
FIGS. 4A and 4B are plan and elevational views, respectively, of a plenum chamber useful in various embodiments of the present invention.
Figure 4B:
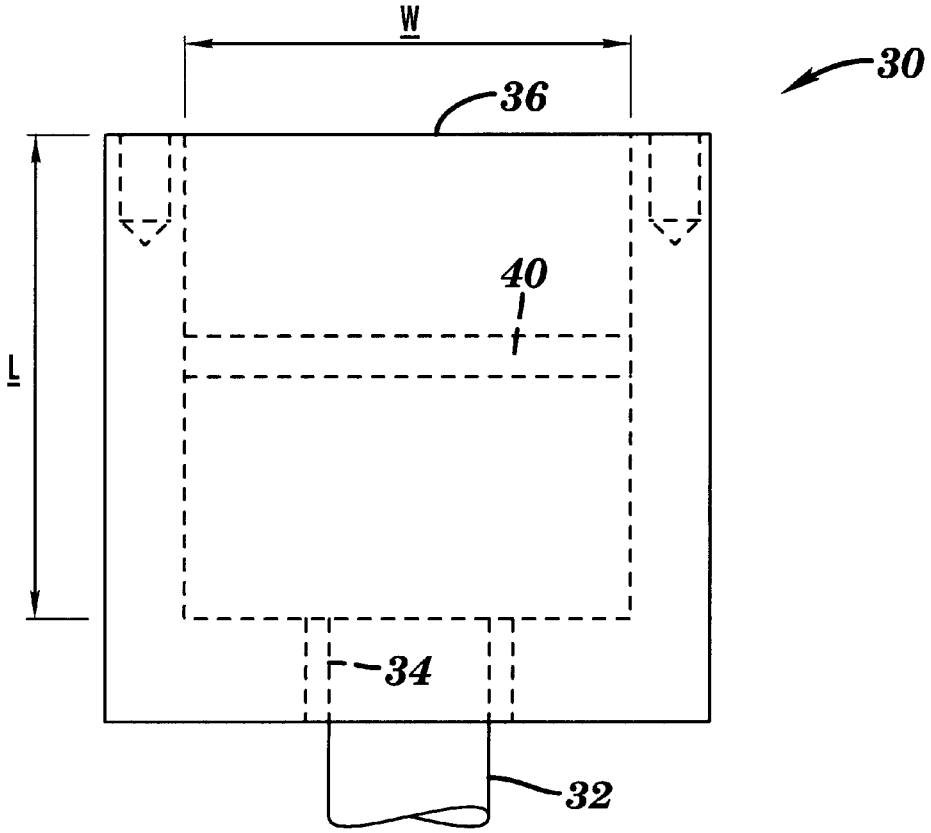
Figure 5C:
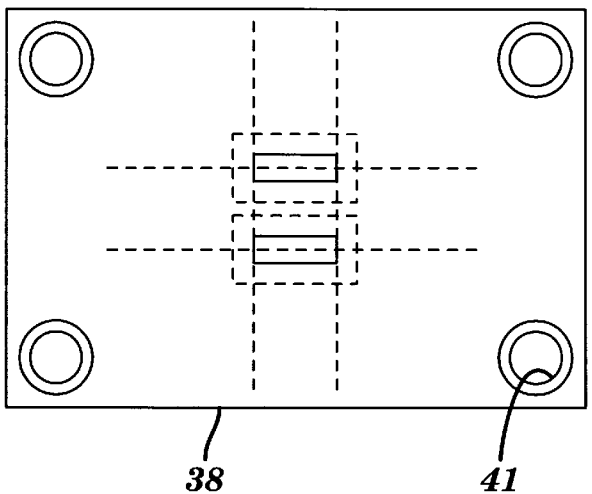
FIG. 5C is a view similar to that of FIG. 5A, of an alternate embodiment of the nozzle plate.
Figure 5B:
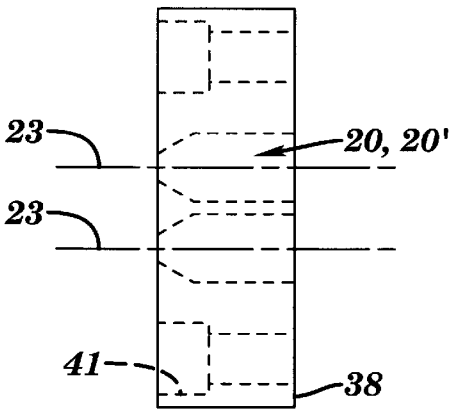
FIGS. 5A and 5B are plan and elevational views, respectively, of an exit nozzle plate configured for use with the plenum chamber of FIGS. 4A and 4B for a particular application.
Figure 5A:
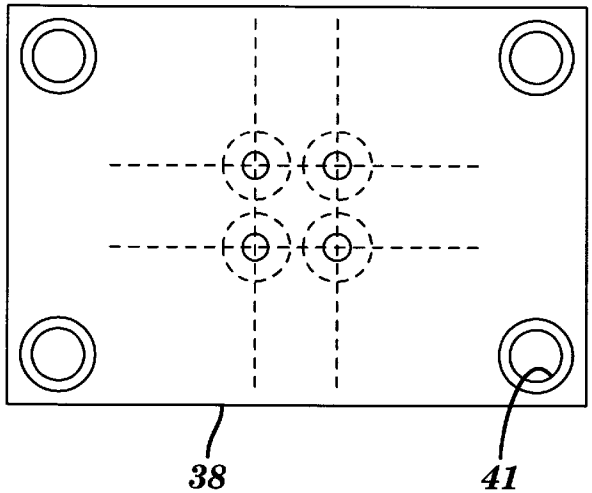
Figure 6:
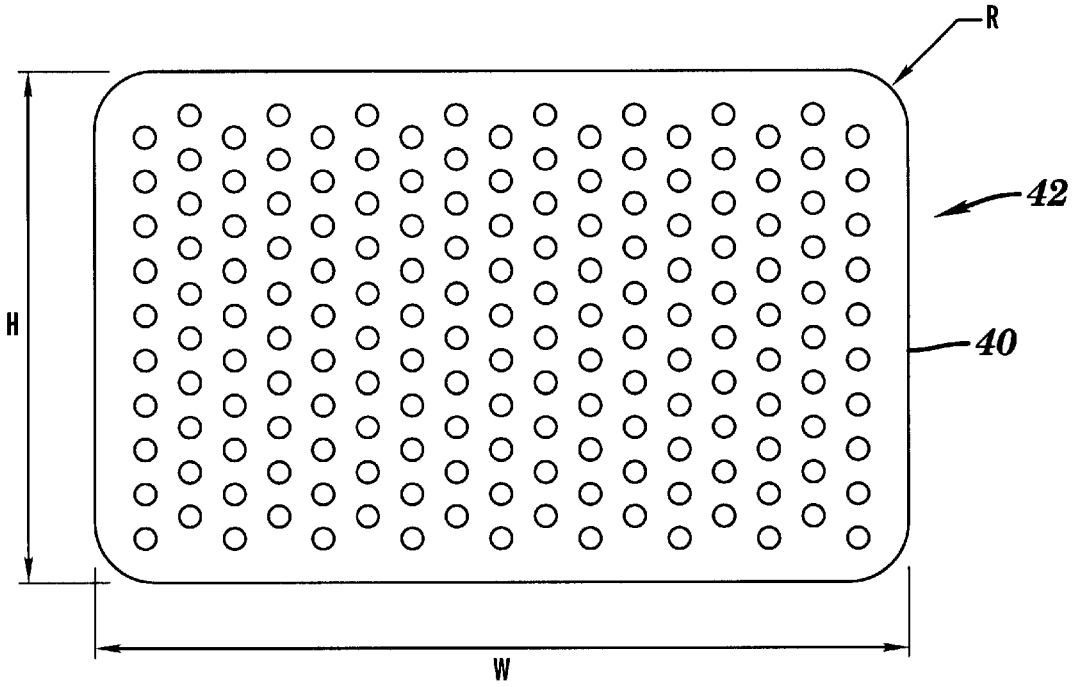
FIG. 6 is a plan view of a flow conditioner configured for use with the plenum chamber of FIGS. 4A and 4B.

Turning now to FIGS. 4–6 a particular embodiment of the present invention is described. As shown in FIGS. 4A and 4B, a plenum chamber 30, which serves as a plenum chamber means, is configured for being coupled to the terminal (i.e., downstream) end of a conventional coolant supply pipe 32 at chamber inlet 34. A downstream face 36 of the chamber is closed by a nozzle plate 38 (FIGS. 5A, 5B, 5C) disposed in sealing contact therewith. The plenum chamber provides a relatively large transverse cross-sectional area relative to that of the pipe 32. This large area serves to reduce the velocity of coolant entering through inlet 32, and allow the coolant to at least partially stabilize prior to exiting the chamber. Chamber 30 may be provided with substantially any geometry capable of providing this large cross-sectional area. In the embodiment shown, chamber 30 is generally rectilinear, having an interior length L, and a cross-sectional area defined by an interior height H and width W. The height H and width W may be determined based upon the size of the grinding wheel being used in a particular application. For example, the width W may be approximately equal to the width of the grinding zone/cut, with the height H of the chamber being sufficiently large to accommodate enough nozzles 20, 20' to match the profile being ground. These dimensions will be discussed in greater detail hereinbelow, e.g., with respect to the embodiment of FIG. 7. Length L is typically at least about equal to the larger of W or H, but may be larger without adversely affecting the performance of the present invention.

Chamber 30 also includes a flow conditioner 40, which extends transversely therein. Conditioner 40 will be discussed in greater detail hereinbelow with respect to FIG. 6.

The skilled artisan will recognize that the coolant supply pipes 32 typically used in grinding machines are generally chosen with as small a diameter/cross-sectional area as possible, based upon both the coolant flow rate requirements of a particular grinding application, and the capacity of the coolant supply pump.

As shown in FIGS. 5A, 5B and 5C, nozzle plate 38 is configured for being removably fastened (e.g., with threaded fasteners extending through bolt holes 41) to chamber 30. The plate 38 also includes a plurality of nozzles 20, 20' disposed in a predetermined arrangement therein. This construction enables provision of various plates 38 having distinct configurations of nozzles 20, 20', which may be easily interchanged (e.g., by removing the threaded fasteners) with a common plenum chamber 30, to serve as modular means for accommodating various grinding operations.

For example, in the embodiment of FIG. 5A, nozzle plate 38 includes four close-coupled nozzles 20. Alternatively, in a variation of this embodiment, rectangular nozzles 20' (FIG. 3), instead of multiple round nozzles 20, may be disposed in plate 38, as shown in FIG. 5C. Referring to FIG. 5B, in these and other embodiments discussed hereinbelow, the nozzles 20, 20' may be placed as close as practicable, without interfering with one another. For example, the nozzles 20 may be placed so that the diameters D of adjacent nozzles are tangential, or even intersecting as shown in FIG. 7C.

Nozzles 20, 20' may be fabricated using any number of well-known techniques, such as machining, casting, or forming. For example, nozzles 20 may be conveniently fabricated using a specially shaped milling tool.

Referring now to FIG. 6, flow conditioner 40 extends transversely within plenum chamber 30 as shown in FIG. 4B, having a periphery that is sized and shaped to match the interior, substantially rectangular cross-section of the chamber 30 for sliding receipt therein. The conditioner may be placed substantially anywhere within the chamber 30, though in many applications, may be optimally placed in the downstream half thereof as shown in FIG. 4B. Conventional indents, detents, or other features (not shown) may be provided on or within the periphery of the conditioner 40 for locating the conditioner at a desired axial location within the chamber 30. As may be seen in FIG. 6, the flow conditioner includes an array of through-holes 42 extending uniformly along substantially the entire surface thereof. The through-holes may be provided with a range of diameters, depending on the grinding application. While substantially any size diameter may be used, a range of about 0.064 to 0.25 inches (0.16 cm to 0.064 cm) may be useful in a variety of applications. In a representative embodiment, a 2 inch×4 inch×0.25 inch (5 cm×10 cm×0.6 cm) conditioner 40 is provided with an array of through-holes 42 having a 0.125 inch (0.32 cm) diameter, spaced 0.19 inches (0.48 cm) (edge to edge) from one another.

Conditioner 40 thus serves as a means for conditioning fluid disposed within said plenum chamber. Flow conditioner 40, of appropriate dimensions as discussed herein, may be used to condition flow through a rectangular chamber 30 upstream of either round nozzle 20 or a rectangular nozzle 20'. The foregoing embodiments have been shown to yield a coherent jet at more than 12 inches (30.5 cm) away from the nozzles 20, 20'. These nozzle assemblies are thus capable of satisfying the cooling requirements of many distinct grinding applications, while being placed further away from the grinding wheel/workpiece interface than similar assemblies of the prior art.

Moreover, although chamber 30 and conditioner 40 are shown & described having rectangular transverse dimensions, they may be configured in other shapes, e.g. circular or non-circular geometries, such as oval, pentagonal, or other polygonal shapes, in various embodiments. Turning now to FIG. 7, alternate embodiments of the present invention include a programmable front plate 38' disposed on the downstream face of plenum chamber 30. The programmable front plate 38' may be used as an alternative to replacing the front plate 38 to accommodate distinct grinding operations. As shown, front plate 38' includes a uniform array of through-holes 42 extending across substantially the entire face thereof. Plate 38' also defines a recess 44 sized and shaped to slidably receive a substantially planar modular card 46 therein. As shown, the card may be inserted in the transverse direction into recess 44. Once so received, the card 46 extends transversely at the downstream end of chamber 30, in superposition with the plate 38'. As shown in FIG. 7C, card 46 includes one or more individual nozzles 20 (or 20', not shown) which are positioned to axially align with respective through-holes 42 when in the fully inserted, superposed orientation. In this manner, card 46 effectively masks off the holes 42 that are not required for a particular grinding operation. As also shown, card 46 and plate 38' may include a detent, stop, or structure, such as provided by head 50, which effectively prevents further insertion of the card once a desired full insertion point has been reached.

Advantageously, a laser pointer or other suitable pointing device, may be projected from the plate 38' towards the profile of the grinding wheel to identify which of the holes 42 are to be selected for a given grinding operation. A card 46 may then be machined with corresponding nozzles 20, 20'. In this manner, a discrete card may be provided for each profile being ground. Advantageously, the coolant nozzle configuration may be adjusted for various distinct grinding operations simply by replacing cards 46 within plate 38', (i.e., without the need to change other coolant system components such as the plenum chamber 30 or piping, etc.). This aspect of the invention thus facilitates quick and highly repeatable set up of the coolant nozzles for each grinding operation, which is thus particularly suitable for small production batches.

In a variation of this embodiment, the front plate 38' may be produced with an open front portion 48 as shown in phantom in FIG. 7A. This open portion 48 may thus eliminate some or all of the holes 42, while still supporting and retaining the card 46 in superposed engagement as described hereinabove. The open-front design allows nozzles 20, 20', of distinct sizes and types to be disposed within a particular card 46, to advantageously permit greater flexibility in the pattern and concentration of jet spray. For example, nozzles of distinct size or shape (e.g., nozzles of both round and rectangular profile), may be used, and may be disposed at locations within the card 46 other than those defined by the array of holes 42. The skilled artisan will recognize that the size of the open portion 48 may be determined in combination with the size (including thickness) of the card 46, so that the card 46 is capable of withstanding the force generated by the fluid pressure within the chamber.

Thus, as described herein, plates 38 and 38' serve as means for removably fastening a plurality of coherent jet nozzles to a downstream side of said plenum chamber. Moreover, although plate 38' has been described as having bores 42, and the cards 46 as having nozzles 20, 20', the skilled artisan should recognize that the bores and nozzles may be reversed without departing from the spirit and scope of this invention. For example, plate 38' may be provided with an array of nozzles, while the card is provided with a desired pattern of bores. During use, upon insertion the card would effectively close some of the nozzles, and open only those required to generate a desired jet spray pattern.

In the embodiments described hereinabove, nozzles 20, 20' associated with a single plenum chamber 30 may be disposed to form a profile. These nozzles may be of the same size (e.g., diameter), or may be of distinct sizes. (In the embodiments of FIG. 7A, the skilled artisan will recognize that unless an opening 48 is used, the maximum size of nozzles 20, 20' will be limited by the size of the bores 42.) Advantageously, use of different size nozzles in the same plenum chamber 30 allows areas of the grinding zone of higher energy (e.g., shoulders and thin sections) to be cooled more than areas of lower energy (e.g., surfaces that are flat/parallel to the wheel axis).

As mentioned hereinabove, embodiments of the present invention may be used for substantially any grinding application, such as creep-feed, surface, slotting, cylindrical grinding. In the cases of internal grinding and flat grinding, if desired the jet may be directed towards the grinding zone at an angle to the surface being ground.

Moreover, although the nozzle assemblies of the present invention have been shown and described for cooling a grinding zone of a grinding operation, the skilled artisan will recognize that embodiments of the invention may similarly be used to supply coolant to a dressing zone of a conventional dressing operation, without departing from the spirit and scope of the present invention. The 'dressing zone' refers to the interface between the grinding wheel and a conventional dressing tool used in conventional grinding wheel dressing operations.

Briefly described, dressing generally involves applying a desired profile to a grinding wheel by engaging the grinding face of the rotating wheel with a plunge or traversing diamond dresser, or with a rotary diamond truer. Since the dressing zone is distinct from the grinding zone (e.g., typically on the opposite side of the wheel from that of the grinding zone) a separate nozzle(s) is utilized. When deep and/or otherwise complex wheel profiles are to be formed by such a dressing/truing operation, it is common for a straight coolant nozzle to be used as an approximation of the actual desired profile. Disadvantageously, this may lead to insufficient coolant application in portions of the dressing zone, and may generate excessive dresser/truer wear, especially in the event the wheel includes sintered sol gel ceramic aluminum oxide abrasives. The various embodiments of the present invention, however, may be used as described herein, to provide a nozzle assembly that matches the desired profile (e.g., by using a matching array of nozzles 20, 20' in a plate 38 or card 46) in the dressing zone, but which is sized for supplying a lower flowrate suitable for dressing operations. (For convenience, the term 'module' may be used herein to refer to either plate 38 or card 46.) For example, a plenum chamber 30 (e.g., with a plate 38') may be provided at both the grinding and dressing zones. A kit may then be provided, which includes a first module (e.g., a card 46), having a pattern of nozzles or bores pre-configured to apply a desired flow pattern at the grinding zone; another module (e.g., card 46), having a pattern of nozzles or bores pre-configured to apply a desired flow pattern at the dressing zone; and optionally, a dressing roller configured to impart a particular desired profile (which corresponds to the pattern of the cards) to the grinding wheel. Use of the modules enables the coolant nozzle configuration at both the grinding zone and the dressing zone to be adjusted for various distinct grinding operations simply by installing the modules, e.g., by disposing cards 46 or plates 38 on their respective plenum chambers, and optionally, installing the dressing roller.

Although the foregoing discussion describes nozzle assemblies associated with a single plenum chamber, it should be recognized that a single plenum chamber may be partitioned, or otherwise divided into two or more sub-chambers without departing from the spirit and scope of the invention. For example, a plenum chamber may be divided into two parallel, side-by-side portions, which may be selectively actuated or closed, depending on the configuration of the nozzles in a card 46 or plate 38 coupled thereto.

Having described various embodiments of the invention, the following is a description of the set-up and operation thereof. This method is described in connection with Table 1 below.

TABLE 1

| | |
|---|---|
| 100 | Determine desired coolant flowrate |
| 102 | Using width of grinding zone, or |
| 104 | Using power consumption during grinding |

TABLE 1-continued

| | |
|---|---|
| 106 | Determine wheel speed at grinding zone (e.g., empirically) |
| 108 | Determine pressure required to produce a coolant jet speed that approximately matches wheel speed |
| 110 | Determine total area of nozzle outlet to achieve desired flowrate at determined pressure |
| 112 | Determine configuration of nozzle(s) |
| 114 | Number and pitch of round nozzles |
| 116 | Rectangular nozzle |

The flowrate of coolant applied to a grinding zone may be determined 100 either using 102 the width of the grinding zone or by using 104 the power being consumed by the grinding process. For example, 25 GPM per inch (4 liters per minute per mm) of grinding wheel contact width is generally effective in many grinding applications. Alternatively, a power-based model of 1.5 to 2 GPM per spindle horsepower (8–10 liters per min per KW) may be more accurate in many applications, since it corresponds to the severity of the grinding operation.

As discussed hereinabove, the coolant jet may optimally be adjusted to reach the grinding zone at a velocity that approximates that of the grinding surface of the grinding wheel. This grinding wheel speed may be determined 106 empirically, i.e., by direct measurement, or by simple calculation using the rotational speed of the wheel and the wheel diameter.

The pressure required to create a jet of known velocity may be determined 108 using an approximation of Bernoulli's equation shown as Eq. 1:

Eq. 1:

$$\Delta P(\text{bar}) = \frac{SG \cdot v_j(\text{m/s})^2}{200} \text{ or}$$

$$\Delta P(\text{psi}) = \frac{SG \cdot v_j(\text{sfpm})^2}{535824}$$

where SG=Specific Gravity of the coolant, and $v_j$=velocity of the coolant in meters/second or surface feet/minute (i.e., the wheel speed determined at 106).

Using Table 2 below, the total area of nozzle(s) outlet may be determined 110, using the flowrate and pressure determined at 100 and 108. As shown, Table 2 is an example (in English and Metric versions) of an optimization chart which correlates pressure and coolant jet speed, to exit aperture size based on either the exit diameter d of a single round nozzle 20, or the combined exit area of a rectangular nozzle 20' or array of nozzles.

TABLE 2

(English)

| jet | coolant nozzle pressure (psi) | | flowrate (GPM) for listed nozzle exit diameters d (inch) or equivalent area (inch$^2$) | | | | | | | | |
|---|---|---|---|---|---|---|---|---|---|---|---|
| speed (fpm) | water SG = 1.0 | mineral oil SG = 0.87 | .003 1/16 | .012 1/8 | .028 3/16 | .049 1/4 | .077 5/16 | .11 3/8 | .15 7/16 | .196 1/2 | area diam |
| 4000 | 30 | 26 | 0.6 | 2 | 5 | 10 | 15 | 22 | 30 | 39 | |
| 5000 | 47 | 41 | 0.7 | 3 | 7 | 12 | 19 | 28 | 37 | 47 | |
| 6000 | 67 | 58 | 1.0 | 4 | 8 | 15 | 23 | 33 | 45 | 58 | |
| 7000 | 91 | 80 | 1.0 | 4 | 10 | 17 | 27 | 39 | 52 | 66 | |
| 8000 | 119 | 104 | 1.2 | 5 | 11 | 19 | 30 | 44 | 59 | 78 | |
| 9000 | 151 | 132 | 1.3 | 5 | 12 | 21 | 34 | 50 | 67 | 85 | |
| 10000 | 187 | 163 | 1.5 | 6 | 14 | 24 | 38 | 55 | 74 | 97 | |
| 11000 | 226 | 196 | 1.6 | 7 | 15 | 26 | 42 | 61 | 81 | 104 | |
| 12000 | 269 | 234 | 1.8 | 7 | 16 | 29 | 45 | 65 | 89 | 116 | |
| 13000 | 315 | 274 | 1.9 | 8 | 18 | 31 | 49 | 72 | 96 | 123 | |
| 14000 | 366 | 318 | 2.1 | 8 | 19 | 34 | 53 | 76 | 104 | 136 | |
| 15000 | 420 | 365 | 2.2 | 9 | 21 | 36 | 57 | 82 | 111 | 142 | |
| 16000 | 478 | 416 | 2.4 | 10 | 22 | 39 | 61 | 87 | 119 | 155 | |
| 17000 | 539 | 469 | 2.5 | 10 | 23 | 40 | 65 | 94 | 126 | 161 | |
| 18000 | 605 | 526 | 2.7 | 11 | 25 | 44 | 68 | 98 | 134 | 174 | |
| 19000 | 674 | 586 | 2.8 | 11 | 26 | 45 | 72 | 105 | 141 | 180 | |
| 20000 | 747 | 650 | 3.0 | 12 | 27 | 48 | 76 | 109 | 148 | 194 | |

TABLE 2

(Metric)

| jet | coolant nozzle pressure (bar) | | flowrate (liter/min) for listed nozzle exit diameters d (mm) or equivalent area (mm$^2$) | | | | | | | | |
|---|---|---|---|---|---|---|---|---|---|---|---|
| speed (m/s) | water SG = 1.0 | mineral oil SG = 0.87 | 0.79 1 | 3.1 2 | 7.1 3 | 12.6 4 | 28 6 | 50 8 | 79 10 | 113 12 | area diam |
| 20 | 2 | 2 | 0.9 | 3.5 | 8.1 | 15 | 33 | 57 | 90 | 129 | |
| 30 | 5 | 4 | 1.2 | 5.3 | 12 | 22 | 49 | 86 | 134 | 193 | |
| 40 | 8 | 7 | 1.5 | 7.1 | 16 | 29 | 64 | 115 | 179 | 258 | |
| 50 | 13 | 11 | 1.8 | 9 | 20 | 36 | 80 | 144 | 224 | 322 | |
| 60 | 18 | 16 | 2.1 | 11 | 24 | 43 | 97 | 172 | 268 | 386 | |
| 80 | 32 | 28 | 2.4 | 14 | 32 | 57 | 129 | 229 | 358 | 516 | |
| 100 | 50 | 44 | 2.7 | 18 | 40 | 72 | 162 | 287 | 448 | 645 | |

TABLE 2-continued (Metric)

| jet | coolant nozzle pressure (bar) | | flowrate (liter/min) for listed nozzle exit diameters d (mm) or equivalent area (mm²) | | | | | | | | |
|---|---|---|---|---|---|---|---|---|---|---|---|
| speed (m/s) | water SG = 1.0 | mineral oil SG = 0.87 | 0.79 1 | 3.1 2 | 7.1 3 | 12.6 4 | 28 6 | 50 8 | 79 10 | 113 12 | area diam |
| 120 | 72 | 63 | 3 | 21 | 49 | 86 | 193 | 344 | 537 | 774 | |
| 140 | 98 | 85 | 3.8 | 25 | 56 | 100 | 226 | 401 | 627 | 903 | |
| 160 | 128 | 111 | 4.5 | 28 | 64 | 115 | 259 | 458 | 716 | 1031 | |
| 180 | 162 | 141 | 5.3 | 33 | 73 | 129 | 290 | 516 | 805 | 1160 | |
| 200 | 200 | 174 | 6.1 | 35 | 81 | 144 | 323 | 573 | 895 | 1289 | |

Knowing the total area of nozzle(s) outlet, the configuration of the nozzle(s) may be determined 112. For example, a single round nozzle 20 or rectangular nozzle 20' may be used 116, or an array/matrix of nozzles 20 may be used 114.

In the event a matrix of nozzles 20 is used, the flowrate of coolant from such a matrix may be described as a function of exit diameter d and linear pitch of the nozzles. (As used herein, the term 'linear pitch' refers to the distance between the center axes of adjacent nozzles 20.) For purposes of the following calculations, it is assumed that the nozzles 20 are closely-packed, i.e., adjacent nozzles 20 are disposed so that a distance of less than about ¼D separates their outer diameters D, such as shown in FIG. 5B. Optionally the diameters D may be intersecting, as shown in FIG. 7C.

The flowrates for a matrix of Y nozzles having an outer diameter D, (and thus a pitch of D,) and an outlet/exit diameter d, may be determined using Eq. 2. (In many applications, a reasonably coherent jet is formed by using a value of d that is less than or equal to about ½ D.) For example, in a grinding operation in which the grinding wheel has a surface velocity in the grinding zone ($v_s$) of 30 m/s, and a plenum pressure of 4.5 bar is used, the flowrates for a plurality of nozzles having an outer diameter D of 6 mm, (and thus a pitch of 6 mm,) and d of 3 mm, may be determined as follows:

Eq. 2:

$$Q'_f = \frac{v_s \times C_d \times 60 \times d^2 \times \pi}{4 \times 1000 \times D} = \frac{30 \times 0.9 \times 60 \times 9 \times 3.14}{24000}$$

$$= 1.9 \text{ liters/min per mm of width}$$

where $C_d$=discharge coefficient of the nozzle, which is approximately 0.9 for the nozzles 20, 20', described herein.

Therefore, specific flowrate $Q'_f$=1.9 l/min per mm at 30 m/s, regardless of the number of nozzles.

The specific flowrate results, using Eq. 2, for four discrete nozzle pitches (i.e., diameters D) are shown in Table 3 below, for different coolant jet speeds.

TABLE 3

| Pitch (and D) (mm) | 20 m/s $Q'_f$ = | 30 m/s $Q'_f$ = | 40 m/s $Q'_f$ = | 50 m/s $Q'_f$ = | 60 m/s $Q'_f$ = |
|---|---|---|---|---|---|
| 6 | 1.3 | 1.9 | 2.5 | 3.2 | 3.8 |
| 10 | 2.1 | 3.2 | 4.2 | 5.3 | 6.4 |
| 12 | 2.6 | 3.8 | 5.1 | 6.4 | 7.6 |
| 15 | 3.2 | 4.8 | 6.4 | 8.0 | 9.5 |

Where the pump fitted to a grinding machine is incapable of supplying sufficient pressure to match the jet speed to the wheel speed, then the apertures of the nozzle(s) may be made (e.g., using Table 1) to support the required flowrate at that lower pressure.

The following illustrative examples are intended to demonstrate certain aspects of the present invention. It is to be understood that these examples should not be construed as limiting.

EXAMPLES

Example 1

Control

Gas turbine components were ground at two locations (Cut A and Cut B), using a conventional grinding machine equipped with a 100 mm wide BLOHM® coolant nozzle having a tapered exit height h which varies from 0.75 mm to 1.5 mm, fed by a conventional 25 mm vertical BLOHM® pipe with an elbow upstream of the nozzle. The coolant pump was rated at 400 liters/min, at 8 bar. Additional grinding conditions were as follows:

Cut A

Grind width of 17 mm;

Table speed of 800 mm/min;

Depth of cut 0.5 mm;

Wheel speed v of 30 m/s;

Total removal rate of 113 mm³/s;

BLOHM® nozzle had an exit area of 26 mm² corresponding to just the width of grinding zone. (Additional width of the BLOHM® nozzle generated wasted flow.)

Cut B

Grind width of 5 mm;

Table speed of 1000 mm/min;

Depth of cut 0.5 mm;

Wheel speed v of 30 m/s;

Total removal rate of 42 mm³/s; and

BLOHM® nozzle had an exit area of 4 mm² corresponding to width of grinding zone. (Additional width of the BLOHM® nozzle generated wasted flow.)

Example 2

Conditions were substantially identical to those of Example 1, except the BLOHM® nozzles were replaced with two coherent nozzles 20 each placed at the end of relatively long (greater than 12 inches or 30.5 cm) and straight 1 inch (2.5 cm) diameter coolant supply hose. The nozzles 20 were directed towards the grinding zone from a point further from the grinding zone than the BLOHM® nozzles. The desired flowrate for Cut A was determined, using the Tables hereinabove, based on matching the wheel speed at 5 bar pressure, to be about 136 liters/minute. The desired flowrate for Cut B was similarly determined to be about 49 liters/minute. Based on the flowrate, the nozzle 20 chosen for Cut A had a diameter d of 10 mm, for an exit area of 79 $mm^2$. The nozzle 20 chosen for Cut B had a diameter d of 6 mm, for an exit area of 28 $mm^2$.

The grinding wheel of this Example 2 required approximately 50 percent less dressing than the grinding wheel of Example 1, for a corresponding increase in useful life of the grinding wheel, reduced cycle time, and minimal wasted coolant flow.

Example 3

A nozzle assembly was fabricated substantially and shown and described hereinabove with respect to FIGS. 4A–6, with a plenum chamber 30 having a width W=4.0 in (10 cm), a length L of 4 in (10 cm), and a height H=2 in (5 cm), with corner radii R of 0.5 in (1.27 cm). A plate 38 was fastened to the downstream face 36 of the chamber 30, and included four nozzles 20 having an entry diameter D of 10 mm, and an exit diameter d of 3 mm. The nozzles 20 were disposed centrally in plate 38 as shown in FIG. 5. The chamber 30 was provided with an inlet aperture 34 of 1 inch (2.5 cm) diameter, which was coupled to a coolant supply pipe of 1 inch (2.5 cm) diameter. Coolant was supplied to the chamber 30 at 65 psi. The dispersion of the jet spray emitted from the nozzles 20 was determined by measuring the height of the spray at various distances from plate 38.

Example 4

The assembly of Example 3 was provided with a conditioner 40 having an array of holes 42 of 0.125 inch (0.32 cm) diameter, and a center-to-center spacing of 0.19 inch (0.48 cm) substantially as shown. The conditioner was placed approximately 1.5 inches (3.8 cm) upstream of the downstream face 36 of chamber 30. Dispersion of the coolant jet was measured in the manner described with respect to Example 3.

Figure 8:
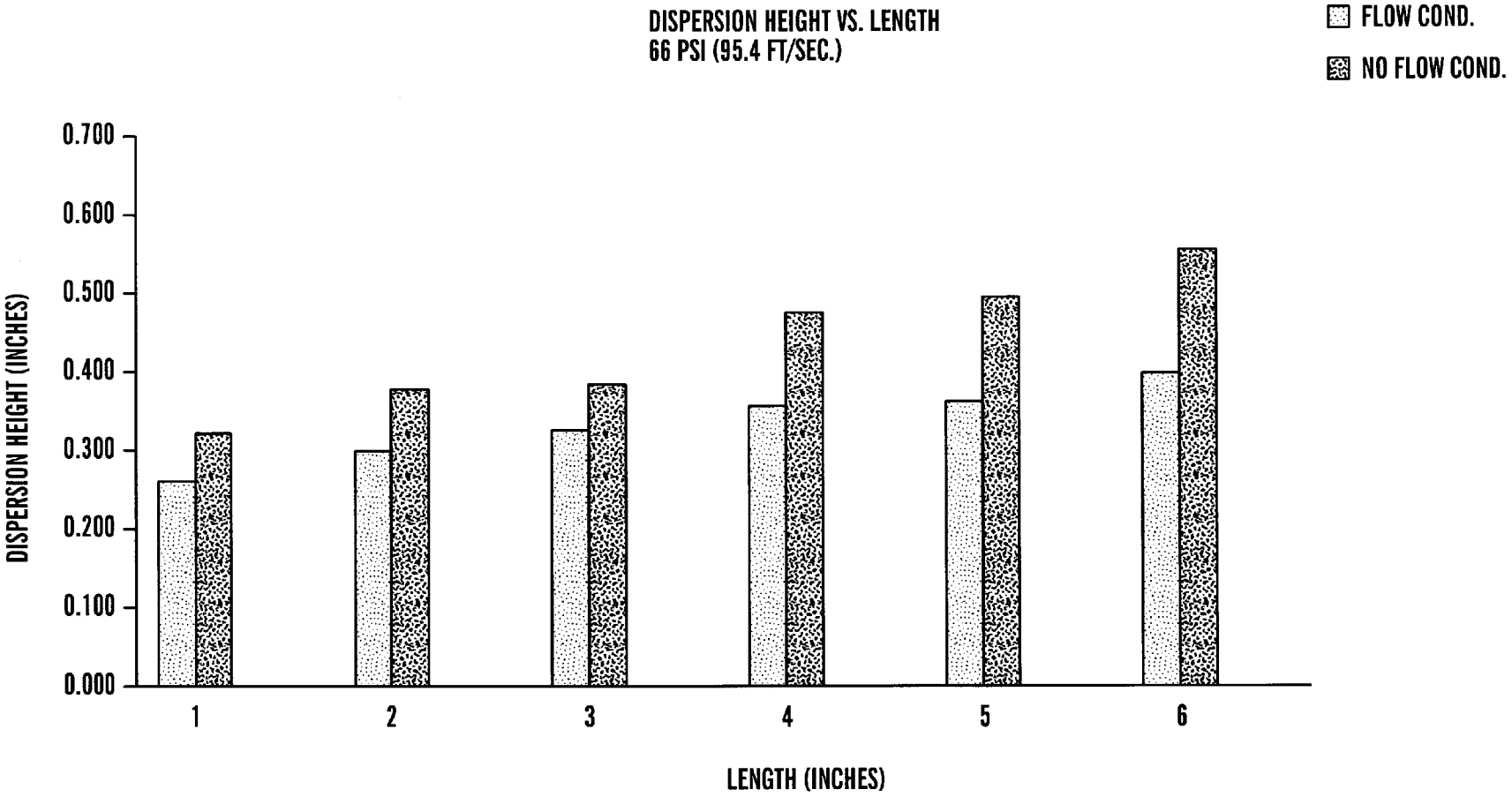
FIG. 8 is a graphical representation of the test results comparing an embodiment of the present invention to a control device.

As shown in FIG. 8, the results of the dispersion tests indicate that the rectangular conditioner of Example 4 consistently reduces dispersion over a range of 1 to 6 inches (2.5 cm to 15.2 cm) from the nozzle outlet, and reduces dispersion by approximately 30 percent at a distance of 6 inches (15.2 cm) from the nozzle outlet.

Although the various embodiments shown and described herein refer to round or rectangular nozzles 20, 20', the skilled artisan should recognize that nozzles of substantially any transverse geometry may be utilized, using suitable approximations of the various dimensional parameters included herein, provided they produce coherent jets as defined herein, without departing from the spirit and scope of the present invention.

Moreover, the skilled artisan should recognize that any suitable means may be utilized to replace the modules (i.e., plates or cards) of the present invention. For example, the modules may be replaced manually, or alternatively, may be replaced automatically, such as by a modified version of a conventional manipulator commonly used to automatically exchange grinding tools between successive treatments of a workpiece in a grinding machine.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A nozzle assembly comprising:

a plenum chamber;

a modular front plate removably fastened to a downstream side of said plenum chamber;

at least one coherent jet nozzle disposed for transmitting fluid through said modular front plate;

the coherent jet nozzle having a proximal end portion having a downstream axis and a transverse dimension D;

a distal end portion;

the distal end portion decreasing in transverse dimension in the downstream direction;

the distal end portion terminating at an outlet having a transverse dimension d;

wherein the ratio D:d is at least about 2:1; and a conditioner disposed within said plenum chamber.

2. The nozzle assembly of claim 1, wherein:

the proximal end portion is cylindrical and has a diameter D;

said proximal end portion fairs into a medial portion having a radius of curvature of at least about 1.5D;

said medial portion has an axial dimension of at least about ¾D;

said medial portion fairs into the distal end portion;

the distal end portion being frusto-conical and having a surface disposed at an angle of at least about 30 degrees relative to the axis;

said distal end portion terminating at an outlet having a diameter d; and wherein a ratio of D:d is at least about 2:1.

3. The nozzle assembly of claim 1, wherein:

said at least one coherent jet nozzle is disposed within said front plate.

4. The nozzle assembly of claim 1, wherein:

said at least one coherent jet nozzle is disposed within a card disposable in superposed relation with said front plate.

5. The nozzle assembly of claim 4, comprising a plurality of coherent jet nozzles.

6. The nozzle assembly of claim 5, wherein:

said front plate comprises at least one opening disposable in axial alignment with said coherent jet nozzles.

7. The nozzle assembly of claim 6, wherein:

said opening comprises a plurality of bores, each bore being disposable in axial alignment with one of said coherent jet nozzles.

8. The nozzle assembly of claim 6, wherein:

said plurality of coherent jet nozzles are configured to simultaneously transmit fluid through said opening.

9. (original) The nozzle assembly of claim 1, wherein:

said conditioner extends transversely relative to a downstream direction of fluid flow through the plenum chamber.

10. The nozzle assembly of claim 9, wherein:

said conditioner has a substantially polygonal transverse cross-section.

11. The nozzle assembly of claim 10, wherein:

said conditioner has a substantially rectangular transverse cross-section.

12. The nozzle assembly of claim 1, wherein said coherent jet nozzle is configured to generate a spray that increases in transverse dimension by no more than about 4 times over a distance of about 30.5 cm from the nozzle.

13. The nozzle assembly of claim 1, wherein said at least one coherent jet nozzle comprises at least one rectangular jet nozzle.

14. The nozzle assembly of claim 1, wherein:

the plenum chamber has a non-circular cross-section in a direction transverse to the downstream fluid flow direction therethrough; and the conditioner is sized and shaped to substantially match said cross-section.

15. The nozzle assembly of claim 14, wherein said at least one coherent jet nozzle comprises an array of coherent jet nozzles.

16. A nozzle assembly comprising:

a plenum chamber configured to pass coolant in a downstream fluid flow direction therethrough;

a plurality of coherent jet nozzles disposed at a downstream end of said plenum chamber;

the coherent jet nozzles each having a proximal end portion having a downstream axis and a transverse dimension D;

a distal end portion;

the distal end portion decreasing in transverse dimension in the downstream direction; and the distal end portion terminating at an outlet having a transverse dimension d;

wherein the ratio D:d is at least about 2:1.

17. The nozzle assembly of claim 16, further comprising a conditioner disposed within said plenum chamber.

18. The nozzle assembly of claim 16, wherein:

at least one of the coherent jet nozzles has a rectangular transverse cross-section.

19. The nozzle assembly of claim 18, further comprising a conditioner disposed within said plenum chamber.

20. A nozzle assembly comprising:

a plenum chamber;

a modular card removably fastenable to a downstream side of said plenum chamber;

at least one coherent jet nozzle disposed within said card for transmitting fluid from said plenum chamber therethrough;

said at least one coherent jet nozzle being configured to generate a spray that increases in transverse dimension by no more than about 4 times over a distance of about 30.5 cm from the nozzle; and a conditioner disposed within said plenum chamber.

21. A nozzle assembly comprising:

means for providing a plenum chamber;

nozzle means for generating a spray that increases in transverse dimension by no more than about 4 times over a distance of about 30.5 cm;

means for removably coupling the nozzle means to a downstream side of said plenum chamber means; and means for conditioning fluid disposed within said plenum chamber.

* * * * *